United States Patent [19]

Najjar et al.

[11] Patent Number: 4,666,464

[45] Date of Patent: May 19, 1987

[54] PARTIAL OXIDATION OF SOLID CARBONACEOUS FUEL-WATER SLURRIES

[75] Inventors: Mitri S. Najjar, Hopewell Junction; Walter C. Gates, Jr., Carmel, both of N.Y.

[73] Assignee: Texaco Inc., White Plains, N.Y.

[21] Appl. No.: 855,037

[22] Filed: Apr. 23, 1986

[51] Int. Cl.[4] ..... C10J 3/46

[52] U.S. Cl. ..... 48/197 R; 48/197 A; 48/202; 48/DIG. 7; 252/373

[58] Field of Search ..... 48/197 R, 202, 206, 48/209, DIG. 7, 197 A; 252/373; 406/197; 44/1 R, 16, 51

[56] References Cited

U.S. PATENT DOCUMENTS

| | | | |
|---|---|---|---|
| 2,864,677 | 12/1958 | Eastman et al. | 48/206 |
| 3,715,195 | 2/1973 | Tassoney et al. | 252/373 |
| 4,018,571 | 4/1977 | Cole et al. | 44/1 R |
| 4,089,656 | 5/1978 | Cole | 44/16 |
| 4,104,035 | 8/1978 | Cole et al. | 47/51 |
| 4,166,802 | 9/1979 | Slater et al. | 48/DIG. 7 |

FOREIGN PATENT DOCUMENTS

| | | | |
|---|---|---|---|
| 156950 | 8/1950 | Australia | 48/DIG. 7 |

*Primary Examiner*—Peter Kratz

*Attorney, Agent, or Firm*—Robert A. Kulason; James J. O'Loughlin; Albert Brent

[57] ABSTRACT

Aqueous slurries of solid carbonaceous fuel having an increased reactivity of the solid material are produced by maintaining the solid carbonaceous fuel-water slurry at a temperature in the range of about 300° to 650° F. and a pressure in the range of about 100 to 3500 psia and sufficient to maintain the $H_2O$ in the slurry in liquid phase; at substantially constant temperature depressurizing said slurry to a pressure in the range of about above atmospheric to 250 psia above that in the reaction zone of a partial oxidation gas generator, thereby partially vaporizing the water in the slurry and producing steam. After depressurizing, the slurry is cooled so that the solid particles drop in temperature about 2° F. to 10° F. and the water in the slurry drops in temperature about 100° F. to about 200° F. the upgraded solid carbonaceous fuel-water slurry is then introduced into the reaction zone of the gas generator with substantially no further charge in pressure and/or temperature except for that resulting from ordinary pressure and/or heat losses in the lines. By the partial oxidation of the upgraded stream of solid carbonaceous fuel-water slurry with a free-oxygen containing gas in the gas generator, synthesis gas, reducing gas, or fuel gas is produced with a greater efficiency.

14 Claims, No Drawings

PARTIAL OXIDATION OF SOLID CARBONACEOUS FUEL-WATER SLURRIES

FIELD OF THE INVENTION

This invention relates to the partial oxidation of solid carbonaceous fuel-water slurries. More particularly, it is concerned with a process in which low rank coal-water slurries are upgraded and fed into a partial oxidation gas generator for the production of synthesis gas, reducing gas, or fuel gas.

In the partial oxidation of solid carbonaceous fuel-water slurries, it is important that the water content of the slurry be minimized in order to reduce the oxygen consumption in the gasifier. In order to be pumpable, aqueous slurries of low grade solid carbonaceous fuel, e.g. sub-bituminous coal and lignite contain over 50 wt. % of water. However, such excessive amounts of water will reduce the thermal efficiency of the partial oxidation process.

Presently, no practical method exists for increasing the solids content of coal-water slurries. Screening of coal-water slurries generally is ineffective when large screens are used and finer screens quickly blind-off. The use of a coal settler to concentrate the slurry may be expensive since settling rates for coal slurry are extremely slow so that the size of this system would be very large. By the subject process, the water in the slurry may be partially or totally vaporized. However, the feedstream of solid carboanceous fuel-water slurry to the partial oxidation gas generator is pumpable and made more reactive.

The partial oxidation of coal-water slurries is described in coassigned U.S. Pat. No. 2,864,677, which is incorporated herein by reference. However in that process, the slurry is passed through a tubular heating zone wherein it is heated to a temperature at least sufficient to convert substantially all of the liquid to vapor. Accordingly, the feed to the gas generator comprises a gasiform dispersion of powdered solids in vapor. Further, there is no beneficiation of the coal particles to improve their reactivity.

Low rank fuels such as sub-bituminous coal and lignite may be beneficiated by hydrothermal treatment. Thus, in coassigned U.S. Pat. No. 4,047,899, low rank coals are beneficiated by treatment with water at elevated temperature under superatmospheric pressure in the presence of hydrogen. In coassigned U.S. Pat. No. 4,089,656, solid fuels which yield low $SO_2$ emission on combustion, are produced by a process which comprises separating the solid fuel into a light portion having a specific gravity of about 1.6 or less and a heavy portion, and subjecting the light portion to hydrothermal treatment. In coassigned U.S. Pat. No. 4,104,035 after the solid fuel-water slurry is subjected to hydrothermal treatment, the slurry is cooled and the pressure is released. The solid fuel is then separated from the slurry water, washed, and reslurried with fresh water and an organic sulfonic acid surfactant.

SUMMARY

In accordance with certain of its aspects, this invention is directed to a process for the production of synthesis gas, reducing gas, or fuel gas in which a feedstream comprising a solid carbonaceous fuel-water slurry is reacted by partial oxidation with a stream of free-oxygen containing gas in a free-flow reaction zone of a gas generator at a temperature in the range of about 1800° F. to 3500° F., and a pressure in the range of about 1 atmosphere to 3200 psia, the improvement comprising:

(1) maintaining said solid carbonaceous fuel-water slurry having a solids content in the range of about 30 to 60 wt. %, and in which the particle size of the solid material is less than about 1400 microns for a time period of about 5 seconds to 5 hours in a slurry treating zone at a temperature in the range of about 300° F. to 650° F., and a total pressure in the range of about 100 to 3500 psia and about 50 to 2400 psia above the total pressure in the reaction zone of the gas generator, and wherein said temperature and pressure are such that the $H_2O$ in said slurry is maintained in the liquid phase;

(2) at substantially constant temperature depressurizing said solid carbonaceous fuel-water slurry to a total pressure in the range of about above atmospheric to 250 psia above the pressure in the reaction zone of said gas generator, thereby partially vaporizing the water in said slurry and producing steam; (3) after (2) cooling said slurry so that solid particles in said slurry drop in temperature about 2° F. to 10° F., and the water in said slurry drops in temperature about 100° F. to about 200° F.; and (4) introducing the upgraded stream of solid carbonaceous fuel-water slurry from (3) into the reaction zone of said gas generator with substantially no change in pressure and/or temperature except for that resulting from ordinary pressure and/or heat loss in the lines. Advantageously, the solid carbonaceous fuel-water slurry may be introduced into the partial oxidation gas generator with a minimal amount of cooling thereby utilizing its thermal energy in an effective way.

DESCRIPTION OF THE INVENTION

The present invention relates to a process for the production of synthesis gas, reducing gas, or fuel gas by reacting a feedstream comprising a solid carbonaceous fuel-water slurry by partial oxidation with a free-oxygen containing gas. However, prior to said partial oxidation reaction the slurry feedstream is upgraded. The partial oxidation reaction takes place in a refractory lined free-flow reaction zone of a vertical steel pressure vessel or gas generator at a temperature in the range of about 1800° F. to 3500° F., such as about 2000° F. to 2600° F., and a pressure in the range of about atmospheric to 3200 psia, such as about 50 to 2500 psia. The atoms of free-oxygen containing gas plus the atoms of organically combined oxygen in the solid carbonaceous fuel to atoms of carbon in the fuel (O/C atomic ratio) is in the range of about 0.7 to 1.6, such as about 0.9 to 1.1. The weight ratio of $H_2O$/fuel is in the range of about 0.67 to 2.4. The reaction time in the gas generator is in the range of about 0.5 seconds to 10 minutes, such as about 0.05 seconds to 1 minute. By the subject invention, prior to the partial oxidation step, the solid fuel is made more reactive thereby increasing the efficiency of the partial oxidation process.

The following solid carbonaceous fuels are suitable feedstocks for the partial oxidation process and include by definition: coal, i.e. anthracite, bituminous, subbituminous, lignite, or peat; particulate carbon; coke from coal; petroleum coke; oil shale; tar sands; asphalt; pitch; and mixtures thereof. By the subject process, the reaction rates are more particularly increased for low rank solid carbonaceous fuels such as subbituminous coal, lignite and peat having a comparatively high content of chemically combined oxygen and a high ash content.

The term free-oxygen containing gas, as used herein is intended to include air, oxygen-enriched air, i.e. greater than 21 mole % oxygen, and substantially pure oxygen, i.e. greater than 95 mole % oxygen (the remainder comprising $N_2$ and rare gases).

The aqueous slurry of solid carbonaceous-fuel having a solids content in the range of about 30 to 60 wt. %, such as about 40 to 50 wt. % is prepared by mixing together comminuted solid carbonaceous fuel having a particle size of less than about 1400 microns.

The solid carbonaceous fuels are preferably ground to a particle size so that 100% of the material passes through an ASTM E11-70 Sieve Designation Standard 1.40 mm (Alternative No. 14) and at least 80% passes through an ASTM E11-70 Sieve Designation Standard 425 μm (Alternative No. 40). The moisture content of the solid carbonaceous fuel particles is in the range of about 0 to 40 wt. %, such as 2 to 20 wt. %. The slurry may be prepared by dispersing the ground material in water. Alternatively, the solid carbonaceous fuel may ground together with the water. The aqueous solids suspending medium may be fresh make-up water or recycle waste water stream derived downstream in the partial oxidation process, e.g. gas scrubbing.

Heating and upgrading of the solid carbonaceous fuel-water slurry may take place by heating the slurry in a slurry treating zone such as an autoclave, or by continuously passing the slurry through a tubular heating coil disposed within a furnace. Alternatively, the slurry may be heated by being passed through a jacketed conduit. The walls of the tubing or conduit must be thick enough to withstand the required pressure. The diameter of the conduit may increase during the depressurization step so that the solid carbonaceous fuel-water slurry may expand. This increase in diameter of the conduit may be gradual or sudden. The slurry treating zone may be pressurized by a gas selected from the group consisting of $N_2$, $H_2$, $CO_2$, synthesis gas, and mixtures thereof. In one embodiment the slurry treating zone is pressurized by a free oxygen-containing gas.

The solid carbonaceous fuel-water slurry feed to the partial oxidation gas generator is first pressurized to a pressure in the range of about 25 psia to 250 psia, such as about 50 psia to 100 psia above the pressure in the gas generator. Further, the total pressure is greater than the vapor pressure of the water carrier at the saturation temperature. Pressurizing of the solid carbonaceous fuel-water slurry can be easily done by pumps, extruders, colloid mill, etc. For example, the aqueous slurry of solid carbonaceous fuel in the slurry treating zone is maintained at a temperature in the range of about 300° F. to 650° F., such as about 400° F. to 600° F., and a total pressure in the range of about 100 to 3500 psia, such as about 300 to 1600 psia, and about 50 to 2400 psia above the total pressure in the reaction zone of the gas generator, for a time period in the range of about 5 seconds to 5 hours, such as about 15 seconds to 1 hour.

In the next step of the process, the solid carbonaceous fuel-water slurry is depressurized at substantially constant temperature to a total pressure in the range of about a little above atmospheric pressure e.g. about 2–25 psia to 250 psia above or say about 50 psia to 100 psia above the pressure in the reaction zone of the gas generator, thereby partially vaporizing the water in said slurry and producing steam. For example, steam in said slurry treating zone may have a quality in the range of about 5% to 90%, such as about 10% to 50%. About 10 to 50 wt. %, such as about 15 to 30 wt. %, of the carrier water may be vaporized during depressurization thereby increasing the solids concentration of the slurry. Substantially constant temperature is by definition a temperature maintained up to ±10° F. The depressurizing step takes place within a period of up to 3 seconds, such as about 0.10 to 2 seconds. For example, the rate of depressurization may be in the range of about 10 to 32,000 psi per sec. After the slurry is depressurized it is cooled. Preferably, the cooling is such that the solid particles in said slurry drop in temperature about 2° F. to 10° F., such as about 4° F. to 6° F., and the water in the slurry drops in temperature about 100° F. to about 200° F., such as about 120°–180° F. Cooling may be effected in a conventional heat exchanger by indirect heat exchange with a coolant.

Depressurization is effected by expansion of the solid carbonaceous fuel-water slurry feedstream in the slurry treating zone. Preferably, the depressurization is sudden. However, in one embodiment the depressurization is gradual. For example, at least a portion of the gases that are produced in the process e.g. $H_2O$, $CO_2$, CO, $CH_4$, $H_2$, and hydrocarbon vapors, and mixtures thereof may be vented through a pressure relief valve at the top of an autoclave, by isenthalpic expansion. The gases may be thereby vented to the atmosphere. Alternatively, the gases may be introduced into the gas generator along with the slurry feedstream. Sudden or gradual depressurization of the slurry stream of solid carbonaceous fuel-water continuously flowing in the conduit to the gas generator may be effected, respectively, by a sudden or gradual increase of the diameter of said conduit.

The upgraded stream of solid carbonaceous fuel-water slurry which is produced by the aforesaid process is then introduced into the reaction zone of the partial oxidation gas generator with substantially no change in pressure and/or substantially no change in temperature except for that resulting from ordinary pressure and/or heat losses in the lines. By definition substantially no change in pressure means maintaining the pressure up to 10 psia. In one embodiment, prior to being fed into the gas generator, the upgraded stream of solid carbonaceous fuel-water slurry is vented to remove at least a portion of a gas selected from the group consisting of $H_2O$, $CO_2$, CO, $H_2$, and mixtures thereof. In another embodiment, supplemental comminuted solid carbonaceous fuel is introduced into said upgraded stream of solid carbonaceous fuel-water slurry to increase the solids content of said slurry prior to being fed into the gas generator. Advantageously, by the limited cooling in the subject process the thermal energy that has been invested in the upgraded solid carbonaceous fuel-water slurry stream is preserved and utilized to improve the thermal efficiency of the partial oxidation step that follows. If the slurry is to be stored, it may be cooled to ambient temperature.

Advantages of the present invention are illustrated by the following specific examples. These examples are set forth for purposes of illustration and should not be construed as limiting the invention.

EXAMPLE I

An aqueous slurry of Lake DeSmet bituminous coal having a solids content of 40.0 wt. % was thermally treated at a temperature of about 611.8° F. and at a pressure of about 2000 psia, for 30 minutes, in an autoclave reactor having a nitrogen atmosphere. Three runs were made under varying conditions. The results are shown in Table I. Run Nos. 2 and 3 were made in accordance with the subject process. Run No. 1 does not typify the subject process and was included for comparative purposes. In Run No. 1, the thermally treated slurry was cooled to room temperature at a pressure of about 2000 psia. The slurry was then depressurized to atmospheric pressure. In Run No. 2, at substantially constant temperature the still warm thermally treated slurry was depressurized to about a little above atmospheric pressure. Depressurization took place by an increase in pressure drop e.g. about 1500 psi per second and about 27 wt. % of the water in the slurry vaporized. The slurry was then cooled to about ambient temperature. In Run No. 3, still warm thermally treated slurry at substantially constant temperature was depressurized to 250 psig. Depressurization took place by an increase in pressure drop e.g. about 1500 psi per second and 22 wt. % of the water in the slurry vaporized. The slurry was then cooled to about ambient temperature and depressurized to about a little above atmospheric pressure.

Results of the analysis of the coal and the recovered char samples are reported in Table I.

TABLE I

Analysis of Lake DeSmet Coal and Chars

| | Coal As Received | | Coal Char Run No. 1 | | Coal Char Run No. 2 | | Coal Char Run No. 3 | |
|---|---|---|---|---|---|---|---|---|
| Analysis | Dry | Dry-Ash-Free | Dry | Dry-Ash-Free | Dry | Dry-Ash-Free | Dry | Dry-Ash-Free |
| % Volatile Matter | 37.7 | 51.6 | 29.6 | 44.6 | 32.2 | 57.2 | 30.2 | 53.6 |
| % Fixed Carbon | 44.2 | 48.4 | 37.8 | 55.4 | 25.3 | 42.8 | 28.0 | 46.4 |
| % Ash | 18.1 | — | 32.5 | — | 42.5 | — | 41.8 | — |
| %1 Conversion | | 0 | | 54.1 | | 70.1 | | 69.2 |
| Btu/lb | | 11,724 | | 12,481 | | 11,790 | | 11,923 |

The effects of thermal treatment alone can be observed from comparing the analysis of Lake DeSmet Coal as received and Lake DeSmet Coal Char from Run No. 1. The increased ash content of the char from Run No. 1 reflects the loss of some volatile components of the coal. The percent conversion of Lake DeSmet Coal as received to coal char as produced in Run No. 1 due to the thermal treatment in Run No. 1 is 54.1 percent.

*% conversion of coal, as received to coal char =

$$100\left[1-\left(\frac{Ao}{100-Ao}\right)\left(\frac{100-A}{A}\right)\right]$$

where Ao is the % Ash in the coal (dry basis) as received, and A is the % Ash in the char (dry basis) for any specific run.

The effect of depressurization, achieved by an increase in pressure drop, coupled with a partial vaporization of water followed by a drop in temperature can be observed by comparing the analysis of thermally treated Lake DeSmet Coal Char from Run Numbers 1 and 3. The higher ash content of the Run No. 3 char compared to the Run. No. 1 char indicates a further loss of volatile components due to depressurization followed by cooling. The fact that the BTU of Run No. 3 char is less than that of the Run No. 1 char indicates that a fraction of the material that is lost due to depressurization has a substantial BTU value. The percent conversion due to thermal treatment and depressurization followed by cooling in Run No. 3 is 69.2 percent. Comparing the results of Run No. 2 char and Run No. 3 char indicates that further depressurization does not substantially affect this conversion. Thus, depressurization when coupled with vaporization of water from the slurry followed by cooling results in the release of volatiles with substantial BTU value at no energy penalty. The volatiles released with their valuable BTU value will enhance the conversion process in the gasifier. A comparison of the fixed carbon and volatile matter contents of Run Numbers 1 and 3 chars indicates that there is more fixed carbon to be gasified from the Run No. 1 char in comparison with the Run No. 3 char. This would require a greater consumption of oxygen. Further, Run No. 3 provides a char having a greater content of the volatile matter. The combustion properties of this volatile matter are better than those obtained with the fixed carbon.

EXAMPLE II

This example will demonstrate the increased reactivity of the fixed carbon in the Lake DeSmet Coal Char that was produced in accordance with the subject invention, e.g. Example I Run No. 3 in comparison with that for Run No. 1. When the coal char is fed to a partial oxidation gasifier it is instantaneously devolatilized. The volatile matter will be consumed by the oxygen and the devolatilized char is then partially gasified by reacting with $CO_2$ and/or steam. The devolatilized char is thereby converted into CO and/or $H_2$. In Example II, the coal chars from Run Nos. 1 and 3 were devolatilized by being heated to a temperature of 1742° F. in a nitrogen atmosphere and then gasified at a temperature of 1742° F., a pressure of about 1 atmosphere, and in an atmosphere containing 15 volume % $CO_2$ and 85 volume % $N_2$. The gasification results shown in Table II indicate that Run No. 3 devolatilized coal char gasified at a faster rate than that for the Run No. 1 devolatilized coal char. Initially the rate for gasifying Run No. 3 devolatilized coal char was twice the rate for gasifying Run No. I devolatilized coal char. This difference in reaction rate would be indicative of that which would take place in the partial oxidation gas generator.

TABLE II

Gasification of Devolatilized Coal Char

| | Run No. 1 Devolatized Coal Char | | | Run No. 3 Devolatilized Coal Char | | |
|---|---|---|---|---|---|---|
| Time (Minutes) | % C | % Ash | % Conversion* | % C | % Ash | % Conversion* |
| 0 | 53.8 | 46.2 | 0.0 | 40.1 | 59.9 | 0.0 |
| 5 | 46.6 | 53.4 | 25.1 | 15.3 | 74.7 | 49.5 |
| 15 | 31.9 | 68.1 | 59.8 | 11.9 | 88.1 | 79.8 |

TABLE II-continued

| Time (Minutes) | Gasification of Devolatilized Coal Char: Run No. 1 Devolatized Coal Char % C | % Ash | % Conversion* | Run No. 3 Devolatilized Coal Char % C | % Ash | % Conversion* |
|---|---|---|---|---|---|---|
| 25 | 15.0 | 85.0 | 84.8 | 0.5 | 99.5 | 99.2 |

$$*\%\ \text{conversion} = 100\left[1 - \left(\frac{Bo}{100 - Bo}\right)\left(\frac{100 - B}{B}\right)\right]$$

Where Bo is the percent ash content (dry basis) at time O for the devolatilized coal char sample, and B is the % ash content (dry basis) of the partially gasified and pyrolyzed char at the time specified in Table II, respectively.

Although modifications and variations of the invention may be made without departing from the spirit and scope thereof, only such limitations should be imposed as are indicated in the appended claims.

We claim:

1. In a process for the production of synthesis gas, reducing gas, or fuel gas in which a feedstream comprising a solid carbonaceous fuel-water slurry is reacted by partial oxidation with a stream of free-oxygen containing gas in a free-flow reaction zone of a gas generator at a temperature in the range of about 1800° F. to 3500° F., and a pressure in the range of about atmospheric to 3200 psia, or higher the improvement comprising:

(1) maintaining said solid carbonaceous fuel-water slurry having a solids content in the range of about 30 to 60 wt. %, and in which the particle size of the solid material is less than about 1400 microns for a time period of about 5 seconds to 5 hours in a slurry treating zone at a temperature in the range of about 300° F. to 650° F., and a total pressure in the range of about 100 to 3500 psia and about 50 to 2400 psia above the total pressure in the reaction zone of the gas generator, and wherein said temperature and pressure are such that the $H_2O$ in said slurry is maintained in the liquid phase;

(2) at substantially constant temperature depressurizing said solid carbonaceous fuel-water slurry to a pressure in the range of about above atmospheric to 250 psia above the pressure in the reaction zone of said gas generator, thereby partially vaporizing the water in said slurry and producing steam; (3) after (2) cooling said slurry so that the solid particles in said slurry drop in temperature about 2° F. to 10° F., and the water in said slurry drops in temperature about 100° F. to about 200° F.; and (4) introducing the upgraded stream of solid carbonaceous fuel-water slurry from (3) into the reaction zone of said gas generator with substantially no further change in pressure and/or temperature except for that resulting from ordinary pressure and/or heat loss in the lines.

2. The process of claim 1 wherein said depressurizing step (2) takes place within a period of up to 3 seconds.

3. The process of claim 1 wherein said depressurizing step (2) takes place in said slurry treating zone.

4. The process of claim 1 wherein said slurry treating zone is a conduit and steps (1) (2) and (3) take place while said solid carbonaceous fuel-water slurry is continuously passing through said conduit on the way to step (4).

5. The process of claim 4 where in step (2) the diameter of said conduit increases and said solid carbonaceous fuel water slurry is subjected to expansion.

6. The process of claim 5 wherein the increase in diameter of said conduit is gradual.

7. The process of claim 5 wherein the increase in diameter of said conduit is sudden.

8. The process of claim 1 wherein steps (1), (2) and (3) take place in an autoclave.

9. The process of claim 1 provided with the additional step prior to step (4) of removing at least a portion of the gases produced in steps (1), (2) and (3), and wherein said gases are selected from the group consisting of $H_2O$, $CO_2$, CO, $CH_4$, $H_2$ hydrocarbon vapors, and mixtures thereof.

10. The process of claim 1 wherein said solid carbonaceous fuel is selected from the group consisting of anthracite coal, bituminous coal, subbituminous coal; coke from coal; lignite; peat; residue derived from coal liquefaction; oil shale; tar sands; petroleum coke; asphalt; pitch; particulate carbon; soot; concentrated sewer sludge; and mixtures thereof.

11. The process of claim 1 provided with the step of venting said upgraded stream of solid carbonaceous fuel-water slurry to remove at least a portion of a gas selected from the group consisting of $H_2O$, $CO_2$, CO, $H_2$, and mixtures thereof prior to step (4).

12. The process of claim 1 provided with the step of introducing supplemental comminuted solid carbonaceous fuel into said upgraded stream of solid carbonaceous fuel-water slurry prior to step (4) to increase the solids content of said slurry.

13. The process of claim 1 wherein the slurry treating zone in (1) is pressurized by a gas selected from the group consisting of $N_2$, $H_2$, $CO_2$, synthesis gas, and mixtures thereof.

14. The process of claim 1 wherein the slurry treating zone in (1) is pressurized by a free oxygen-containing gas.

* * * * *